US009790955B2

(12) United States Patent
Scouarnec et al.

(10) Patent No.: US 9,790,955 B2
(45) Date of Patent: Oct. 17, 2017

(54) IMPELLER FOR MOTOR VEHICLE FAN, INCLUDING SEGMENTED HUB STIFFENERS

(71) Applicant: Valeo Systemes Thermiques, Le Mesnil Saint Denis (FR)

(72) Inventors: Denis Scouarnec, Versailles (FR); Antoine Levasseur, Montigny-le-Bretonneux (FR)

(73) Assignee: VALEO SYSTEMES THERMIQUES, Le Mesnil Saint Denis (FR)

( * ) Notice: Subject to any disclaimer, the term of this patent is extended or adjusted under 35 U.S.C. 154(b) by 252 days.

(21) Appl. No.: 14/394,972

(22) PCT Filed: Mar. 22, 2013

(86) PCT No.: PCT/EP2013/056143

§ 371 (c)(1),
(2) Date: Oct. 16, 2014

(87) PCT Pub. No.: WO2013/156255

PCT Pub. Date: Oct. 24, 2013

(65) Prior Publication Data

US 2015/0071787 A1 Mar. 12, 2015

(30) Foreign Application Priority Data

Apr. 16, 2012 (FR) ..... 12 53461

(51) Int. Cl.
*F04D 29/32* (2006.01)
*F01P 5/02* (2006.01)

(52) U.S. Cl.
CPC ..... *F04D 29/329* (2013.01); *F01P 5/02* (2013.01)

(58) Field of Classification Search
CPC ..... F04D 29/329; F01P 5/02
(Continued)

(56) References Cited

U.S. PATENT DOCUMENTS 8,016,574 B2 * 9/2011 De Filippis ..... F04D 25/082 310/59
2004/0223845 A1 11/2004 Caplan et al.
2011/0280729 A1 11/2011 Cot et al.

FOREIGN PATENT DOCUMENTS

EP 0 704 626 A2 4/1996
JP 2009-250131 A 10/2009

OTHER PUBLICATIONS

International Search Report for Application No. PCT/EP2013/056143 dated May 6, 2013, 5 pages.
(Continued)

*Primary Examiner* — Richard Edgar
(74) *Attorney, Agent, or Firm* — Howard & Howard Attorneys PLLC

(57) ABSTRACT

A blower wheel for setting a flow of air in circulation has vanes (2) that extend from a vane root attached to a hub (6) of the blower wheel. The hub (6) has a bottom wall (8) through which a through-orifice (12) for a drive shaft of the blower wheel passes, and a side wall (10). The hub (6) also has at least one rib (14) located between the orifice (12) and the side wall (10). The rib (14) is formed by one or more segments (14*a*, 14*b*, 14*c*, 14*d*). The segment, or one of the segments (14*a*, 14*b*, 14*c*, 14*d*), has at least one free edge (15) extending from the bottom wall (8) and facing toward the side wall (10).

16 Claims, 2 Drawing Sheets

(58) Field of Classification Search
USPC ..... 416/169 A
See application file for complete search history.

(56) References Cited

OTHER PUBLICATIONS

English language abstract and machine-assisted English translation for JP 2009-250131 extracted from the PAJ database on Oct. 27, 2014, 22 pages.

* cited by examiner

IMPELLER FOR MOTOR VEHICLE FAN, INCLUDING SEGMENTED HUB STIFFENERS

RELATED APPLICATIONS

This application is the National Stage of International Patent Application No. PCT/EP2013/056143, filed on Mar. 22, 2013, which claims priority to and all the advantages of French Patent Application No. 12/53461, filed on Apr. 16, 2012, the content of which is incorporated herein by reference.

The field of the present invention is that of motor vehicles, and more particularly that of the circulation of air for cooling equipment of the vehicle, in particular the engine thereof.

Vehicles having a combustion engine need to remove the heat generated during their operation and to this end are equipped with heat exchangers, in particular cooling radiators, which are placed at the front of the vehicle and through which outside air passes. In order to force the circulation of this air through the heat exchanger or heat exchangers, a fan is placed upstream or downstream of the latter, upstream or downstream being understood in this document with reference to the direction of flow of the air.

The fan has a blower wheel which serves to force the circulation of air; it is characterized by a high flow rate and low pressure and has very axially oriented flow. This blower wheel consists of a plurality of vanes which are attached at one end to a central hub, through which its drive shaft passes, and at the other end generally to a peripheral shroud which rigidifies the set of vanes.

This blower wheel is subjected to mechanical stresses on account of the rotation and on account of the mechanical and aerodynamic forces which are exerted thereon. The hub and/or the vanes are thus likely to deform and to exhibit a number of particular vibrational modes. A common example of deformation is bending of the vanes in response to a harmonic of the speed of rotation of the electric drive motor. In order to avoid deterioration of the blower wheel or even a simple reduction in its service life, and also the discomfort caused to the driver and passengers by the establishment and transmission of the vibrations, it is important to reduce as far as possible the vibrational responses of the blower wheel to the stresses brought about by the rotation of the drive motor.

A number of solutions have been conceived of to solve this problem. A first approach consists in making the connection between the fan and the motor more flexible, so as to transmit vibrational stresses to a lesser extent. This solution has problems of reducing the service life of the blower wheel, but it also conflicts with the specifications of motor manufacturers which require, inter alia, a metal connection for fixing the fan to the motor.

Furthermore, it is known to provide the hub with ribs that have a role of setting the air inside said hub in movement in order to cool the electric drive motor of the blower wheel located therein. These ribs have an additional function in that they help to reinforce the robustness of the blower wheel. However, they do not reduce the vibrational phenomena.

Various solutions consisting in reducing the rigidity of the hub have been implemented, such as a curved shape given to the abovementioned ribs or the creation of radial slots in the surface of the hub, in which case the property of sealing of the latter is lost. The elimination of said ribs in the region of the center of the hub has also been proposed, but this results in risks of the front face thereof deforming in response to the mechanical stresses of the drive shaft.

The aim of the present invention is to remedy these drawbacks by proposing a fan which affords greater flexibility than the prior art in the region of the connection between the drive motor and the vanes, while remaining simple and economically inexpensive to produce.

To this end, the subject of the invention is a blower wheel for setting a flow of air in circulation, having vanes that extend from a vane root attached to a hub of said blower wheel, said hub having a bottom wall through which a through-orifice for a drive shaft of said blower wheel passes, and a side wall, said hub also having at least one rib located between said orifice and said side wall.

In addition to a function of rigidifying the hub, said ribs have a role of setting the air inside said hub in movement, in particular in order to cool the electric drive motor of the blower wheel, which is provided in a manner housed in said hub.

According to the invention, said rib is formed by one or more segments, the or one of the segments having at least one free edge extending from said bottom wall and facing toward said side wall. In other words, said segment is not connected to said side wall of the hub.

In this way, a rib, but only a partial one, is retained between the center of the hub and the periphery thereof, thereby making it possible to confer a degree of robustness and a degree of agitation on the air inside the hub. However, since said rib is barely connected to the side wall of the hub, if at all, this avoids giving said hub excessive rigidity.

In other words, each stiffener consists of non-contiguous segments. The segmentation of the stiffeners, while decreasing the length thereof, makes it possible to reduce the rigidity of the hub and thus to transmit stresses that are brought about by the drive motor of the blower wheel to a lesser extent to the latter.

Said through-orifice may be located in a boss for guiding the shaft, for example originating from the bottom of said hub, and the or one of said segments that has at least one free edge, extending from said bottom wall and facing toward said side wall, extends from said boss.

According to one particular embodiment of the invention, another of said segments of said guide rib extends, for example, from said side wall, said other of said segments having at least one free edge extending from said bottom wall and facing toward said through-orifice. Specifically, in order to improve robustness, the decision could be made to keep a part of the rib, but only a part, connected to the side edge of the hub.

According to various embodiments of the invention, which could be taken together or separately:

- said vanes extend in the direction of a vane tip, optionally attached to a shroud,
- said bottom wall is oriented radially,
- said guide boss surrounds said through-orifice for the drive shaft of said blower wheel,
- said segments of a single rib extend axially from the bottom,
- said segments of a single rib extend radially,
- all or some of said segments of a single rib are aligned,
- said segments of a single rib are curvilinear segments,
- all or some of said segments of a single rib are in line with one another,
- said segments of a single rib have a radial extension and the sum of the radial extensions of the segments of a single stiffener is between 25 and 75% of the overall radial extension of said rib,
- said rib consists of said segments extending from the boss and from said side wall, said rib also has at least one additional segment, located between said segments extending from the boss and from said side wall, known as end segments, in a non-contiguous manner with the latter.

In the particular embodiment in which the stiffener has only the two end segments, a hub which has limited rigidity but in which the central and side parts remain not very deformable is obtained.

In the particular embodiment in which said stiffener also has at least one additional segment, the rigidity of the hub can be altered, in order to obtain both good mechanical strength and reduced rigidity, by varying the number and position of said segments on the diameter of the stiffener.

In an alternative embodiment, the two end segments are aligned, said additional segment or segments being angularly offset with respect to said end segments.

The invention also relates to a motor vehicle fan having a blower wheel as described above, and to a motor vehicle cooling module comprising such a fan.

The invention will be better understood, and further aims, details, features and advantages thereof will become more clearly apparent from the following detailed explanatory description of an embodiment of the invention that is given purely by way of illustrative and nonlimiting example, with reference to the appended schematic drawings, in which.

Figure 1:
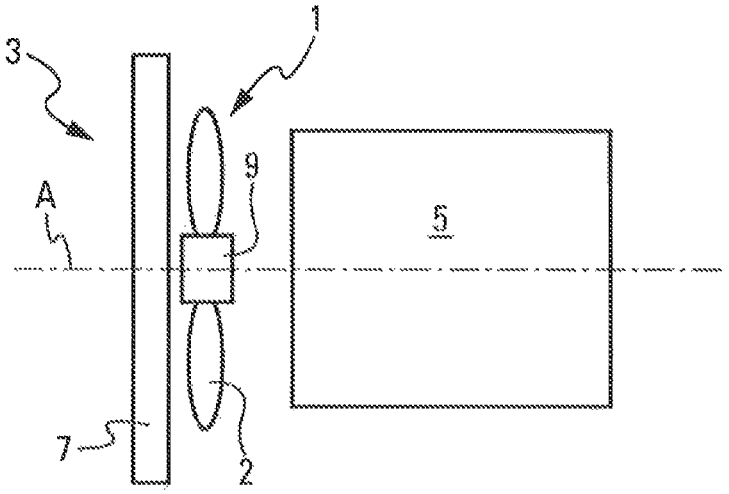
FIG. 1 is a simplified and schematic view of a cooling module for an engine block of a motor vehicle.

Referring to FIG. 1, a cooling module 3 for an engine block 5 of a motor vehicle can be seen. Said module comprises in particular a blower wheel 1 and a heat exchanger 7 such as a cooling radiator of the engine 5. The blower wheel 1, shown here between the cooling radiator 7 and the engine block 5, can be arranged either in front of or behind the radiator 7. These elements 1, 5 and 7 are substantially aligned axially.

The blower wheel 1 is mounted so as to rotate about an axis A. When the blower wheel 1 is driven in rotation, for example by an electric motor 9, the vanes 2 thereof agitate the air passing through it. The flow of air thus flows in a direction of flow oriented approximately from the heat exchanger 7 to the engine block 5.

Figure 2:
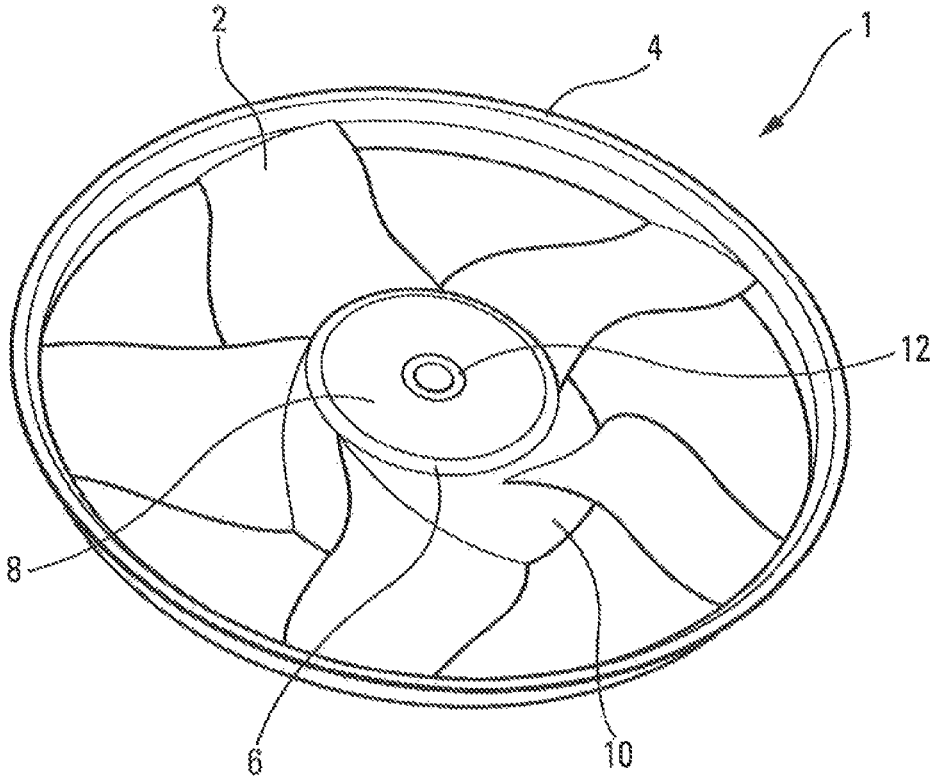
FIG. 2 is a perspective view of a blower wheel for the fan from FIG. 1.

This blower wheel 1, which is produced, for example, by molding and is illustrated in FIG. 2, comprises:

- a central hub 6, also known as a "bowl", which is hollow in order to be able to contain the drive motor 9,
- a plurality of vanes 2, in this case five thereof, having first ends which are fixed to the hub 6 and which extend radially from this hub,
- and a peripheral shroud 4 to which the second ends of the vanes 2 are connected.

For its external shape, the hub 6 has an upstream front wall 8 and a side wall 10, in this case having a substantially frustoconical overall shape, which extends downstream from the front wall and to which the first ends of the vanes 2 are connected. The front wall 8 has a central orifice 12 in which the shaft of the electric motor which drives the blower wheel 1 in rotation is fixed. This electric motor is generally mounted coaxially with the hub 6 of the blower wheel 1.

Figure 3:
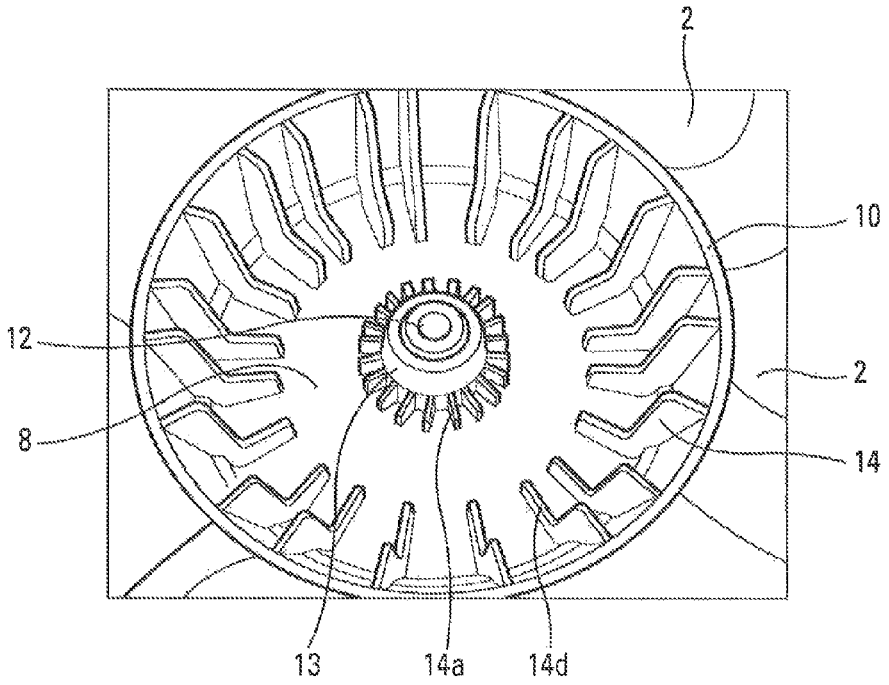
FIG. 3 is a bottom view of the hub of the blower wheel from FIG. 2, according to one embodiment of the invention.

FIG. 3 shows a bottom view of the hub 6 of the blower wheel 1. It has the shape of a hollow bell with a flat bottom, the bottom of which corresponds to the front wall 8 and the side wall of which corresponds to the frustoconical wall 10. Located at the center of the front wall is a reinforcing boss 13 for passing the shaft of the drive motor through the hub 6 and holding it there. As shown, this boss has, without this shape being imperative, a shape exhibiting symmetry of revolution, in particular that of a hemisphere positioned on the bottom of the front wall 8. However, the presence of a central boss is not obligatory for the realization of the invention.

From this spherical boss 13 there extend a whole series of ribs or stiffeners 14 which are oriented radially from the boss 13 toward the side wall 10. Conventionally, in the prior art, these stiffeners have the shape of flat plates which are angularly offset with respect to one another and which are attached, successively, to the boss 13, to the bottom 8 and to the side wall 10. They extend axially over a substantially constant height, except for their radially outer ends which continue over the entire height of the side wall 10. Whereas in the prior art these plates extended continuously as far as the side wall, either from the central boss or from an intermediate point on the diameter, in the invention, these flat plates are discontinuous and have non-contiguous segments, which are aligned with one another along a diameter, between the central boss 13 and the side wall 10. Thus, segments of a single stiffener, that is to say which are located in line with one another, are angularly offset with respect to segments of another stiffener. The segments are, for example, made in one piece with the hub or overmolded onto this hub, it being possible for the latter to be made, in particular, of plastics material.

Figure 4:
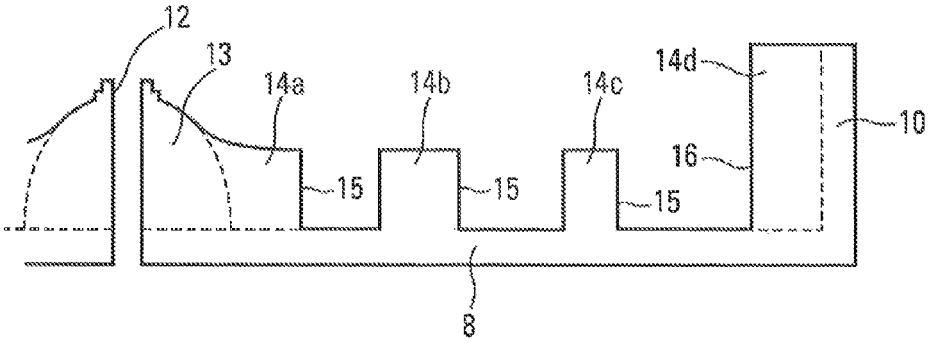
FIG. 4 is a sectional view of the hub from FIG. 3, in a variant embodiment of the invention.

In the embodiment shown in FIG. 3, only two segments of stiffeners are provided, a first 14*a* attached to the central boss and a second 14*d* attached to the side wall. In this way, the bottom 8 is left free of any stiffener over the majority of the corresponding diameter. In an alternative embodiment, illustrated in half-section in FIG. 4, the stiffener 14 has four non-contiguous segments, having the references 14*a* to 14*d*, the first 14*a* being, as above, attached to the central boss 13 and the last 14*d* being attached to the side wall 10. In addition, two intermediate segments 14*b* and 14*c* extend axially from the bottom 8, being disposed in the same radial plane as the two end segments 14*a* and 14*d* of the corresponding stiffener.

The benefit of the invention compared with the devices of the prior art will now be described. By reducing the longitudinal span of the stiffeners 14, the invention makes it possible to reduce the rigidity of the hub and thus to limit the transfer, via the hub 6, the vanes 2 and the shroud 4, of the vibrations brought about by the motor, via its drive shaft. It is thus possible to reduce the stresses to which the blower wheel is subjected during operation and to keep it in a substantially stationary form, in particular with respect to specific damaging vibrational stresses which are transmitted through its environment.

The invention is also characterized by the flexibility provided by the possibility of adding intermediate segments 14*b* and 14*c*. By acting on the number of intermediate segments installed, on their position on the diameter of the base 8 and on their length and, in this way, on the overall length of the segments of a stiffener 14, it is possible to alter the rigidity of the hub 6 and thus the vibrational response of the blower wheel. There is thus a degree of freedom which the prior art does not have in order to manage the vibrational response of the blower wheel and to avoid any deterioration thereof in use.

It is furthermore noted that the stiffeners are not eliminated and that they continue to carry out their function that they had in the prior art devices of setting the air inside the hub in movement, thus making it possible to preserve aerodynamic cooling of the electric drive motor of the blower wheel. The length and the position that are selected for the various intermediate segments are thus, in the case of the invention, the result of a compromise between, on the one hand, a favorable response to vibrational stresses and, on the other hand, the generation of necessary setting of the air inside the hub 6 in movement.

Further variants are possible, relating in particular to the direction and the curvature of the stiffeners, as long as these stiffeners are segmented and these segments are non-contiguous. Two segments are considered to belong to a single curved stiffener when the curve which joins them does not have a point of inflection. The two end segments 14*a* and 14*d* are advantageous for ensuring rigidity and sufficient mechanical strength of the bottom 8 both in the region of its attachment to the central boss 13 and of that of the side wall 10.

The segments 14*a* to 14*d* have been shown straight and positioned in alignment with one another. The invention can also be realized with intermediate, straight or curved, segments which are not aligned with the end segments 14*a* and 14*d*. Staggered forms of alignment may be envisioned, the intermediate segments being positioned on either side of the main line of the stiffener 14 with an orientation parallel to that of the end segments.

In a practical manner, the sum of the radial extensions of the segments of a stiffener according to the invention is considered to be between 25 and 75% of the radial extension of the stiffener, the radial extension being calculated along a radius or a curve extending without an inflection point from the boss 13 to the side wall 10.

The invention claimed is:

1. A blower wheel for setting a flow of air in circulation comprises vanes that extend from a vane root attached to a hub of said blower wheel, said hub having a bottom wall through which a through-orifice for a drive shaft of said blower wheel passes, and a side wall, said hub also having at least one rib located between said orifice and said side wall, wherein said rib is formed by one or more segments, with said segment or said segments having at least one free edge extending from said bottom wall and facing toward said side wall, wherein another of said segments of said rib extends from said side wall, said other of said segments having at least one free edge extending from said bottom wall and facing toward said through orifice, and wherein said rib has at least two of said segments, known as end segments, and at least one additional said segment is located between said end segments in a non-contiguous manner with said end segments.

2. The blower wheel as claimed in claim 1, wherein said through-orifice is located in a boss for guiding the drive shaft, and said segment or one of said segments that has at least one free edge extending from said bottom wall and facing toward said side wall extends from said boss.

3. The blower wheel as claimed in claim 2, wherein said segments of a single rib extend axially from said bottom wall.

4. The blower wheel as claimed in claim 1, wherein said segments of a single rib extend axially from said bottom wall.

5. The blower wheel as claimed in claim 1, wherein said segments of a single rib extend radially.

6. The blower wheel as claimed in claim 1, wherein all or some of said segments of a single rib are aligned.

7. The blower wheel as claimed in claim 1, wherein said segments of a single rib are curvilinear segments.

8. The blower wheel as claimed in claim 7, wherein all or some of said segments of a single rib are in line with one another.

9. The blower wheel as claimed in claim 1, wherein said segments of a single rib have a radial extension and the sum of the radial extensions of said segments is between 25 and 75% of the overall radial extension of said rib.

10. The blower wheel as claimed in claim 1, wherein said end segments are aligned, with said additional segment or segments being angularly offset with respect to said end segments.

11. A motor vehicle fan having a blower wheel as claimed in claim 1.

12. A motor vehicle cooling module comprising a fan as claimed in claim 11.

13. A blower wheel for setting a flow of air in circulation comprises vanes that extend from a vane root attached to a hub of said blower wheel, said hub having a bottom wall through which a through-orifice for a drive shaft of said blower wheel passes, and a side wall, said hub also having at least one rib located between said orifice and said side wall, wherein said rib is formed by one or more segments, with said segment or said segments having at least one free edge extending from said bottom wall and facing toward said side wall, wherein said rib has at least two of said segments, known as end segments, and at least one additional said segment is located between said end segments in a non-contiguous manner with said end segments, and wherein said end segments are aligned, with said additional segment or segments being angularly offset with respect to said end segments.

14. The blower wheel as claimed in claim 13, wherein said through-orifice is located in a boss for guiding the drive shaft, and said segment or one of said segments that has at least one free edge extending from said bottom wall and facing toward said side wall extends from said boss.

15. The blower wheel as claimed in claim 13, wherein said segments of a single rib are curvilinear segments.

16. The blower wheel as claimed in claim 15, wherein all or some of said segments of a single rib are in line with one another.

* * * * *